United States Patent [19]

Tolleson et al.

[11] Patent Number: 4,869,552

[45] Date of Patent: Sep. 26, 1989

[54] FLEXIBLE BACKREST ASSEMBLY FOR A CHAIR

[75] Inventors: Thomas H. Tolleson, Morristown; Gregory M. Saul, Jefferson City; R. Duane Ware, Morristown, all of Tenn.

[73] Assignee: Shelby Williams Industries, Inc., Morristown, Tenn.

[21] Appl. No.: 244,663

[22] Filed: Sep. 14, 1988

[51] Int. Cl.[4] ..... A47C 3/00

[52] U.S. Cl. ..... 297/296; 248/160; 297/306; 403/220; 403/291

[58] Field of Search ..... 297/285, 294, 296, 297, 297/300, 306, 353, 354, 443, 444; 248/160, 629, 630; 267/158, 160; 403/220, 223, 291

[56] References Cited

U.S. PATENT DOCUMENTS

| | | | |
|---|---|---|---|
| 2,587,822 | 3/1952 | Corning | 297/306 X |
| 2,732,005 | 1/1956 | Corning | 297/306 |
| 4,084,850 | 4/1978 | Ambasz | 297/317 |
| 4,549,264 | 10/1985 | Haedo | 297/296 |
| 4,580,836 | 4/1986 | Verney | 297/296 |
| 4,603,904 | 8/1986 | Tolleson et al. | 297/296 |
| 4,733,910 | 3/1988 | Brennan | 297/306 X |

FOREIGN PATENT DOCUMENTS

| | | | |
|---|---|---|---|
| 2619538 | 11/1977 | Fed. Rep. of Germany | 297/296 |
| 860938 | 1/1941 | France | 297/306 |

*Primary Examiner*—Peter R. Brown

*Attorney, Agent, or Firm*—Myron C. Cass

[57] ABSTRACT

A chair which includes a seat frame having depending leg members and a pair of upstanding, spaced apart members arranged to provide a lower backrest part for the chair and an upper backrest frame part having a pair of spaced apart depending members in registry with the upstanding members, said members being hollow with open extremities, and flexible spring means secured between each pair of members to provide an articulated, flexible spring backrest for the chair. Each flexible spring means includes an elongated, flat or blade spring member having its opposite ends secured within a holder member which is closed at one end and open at its opposite end for inserting the spring into the holder. The open ends of each holder have stop flange formations protruding outwardly thereon which, when the holders are spaced apart at their open ends with a slight gap therebetween, effect limitation of the angle of flexure of the spring by engagement of the flanges one with the other.

16 Claims, 1 Drawing Sheet

FIG. 1
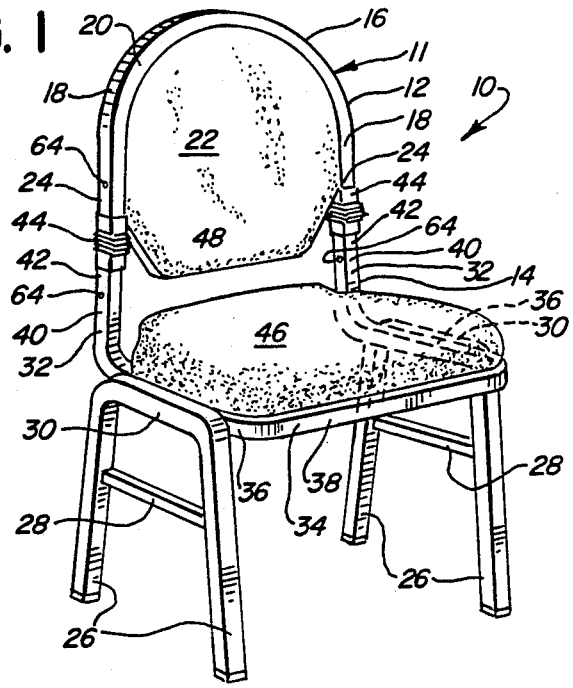
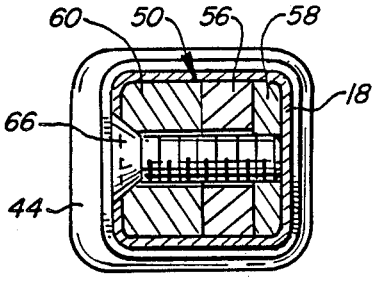
FIG. 4
FIG. 2
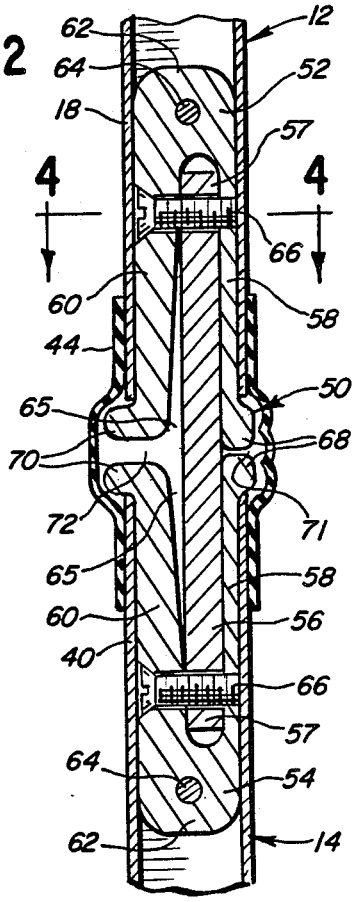
FIG. 3
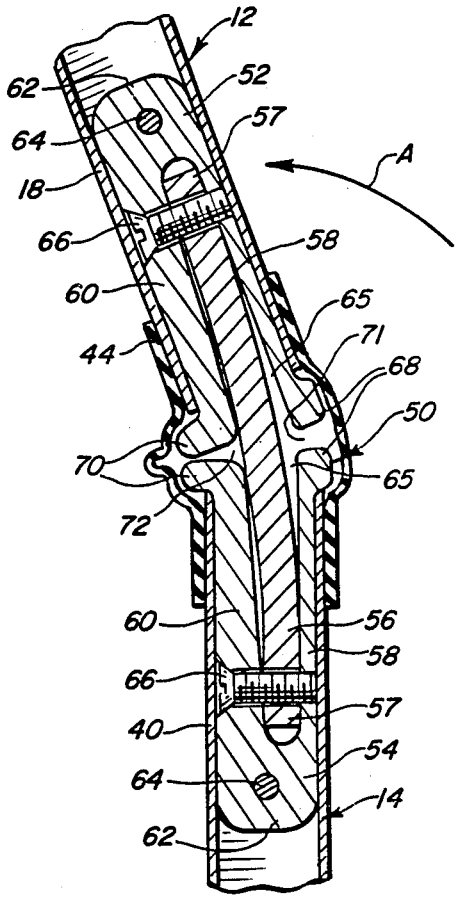

FLEXIBLE BACKREST ASSEMBLY FOR A CHAIR

FIELD OF THE INVENTION

This invention relates generally to chairs having flexible, articulated backrests and more particularly, to a chair frame having upper and lower backrest frame parts joined by a flexible spring assembly.

BACKGROUND OF THE INVENTION

Chairs having articulated, flexible backrest parts for achieving desired support and comfort for the user are known in the art. Such chairs are used, for example, in banquet and conference facilities where back comfort for the seated individual is desirable. Chairs of this type typically are stackable and have molded backrest parts and peripheral frame parts of hollow construction to enable interconnection of upper and lower backrest parts which are flexible one relative to the other. Various types of flexible spring arrangements for joining the upper and lower backrest parts of such chairs are known. An example of such a spring arrangement is disclosed in U.S. Pat. No. 4,603,904 which is assigned to the same assignee as the assignee herein.

The chair disclosed in U.S. Pat. No. 4,603,904 includes an articulated, flexible backrest having a spring means that includes an elongated plastic support strut having a hollow passageway that is fitted with a flexible core. The flexible core comprises a wire cable or the like whose structural specification is selected to limit to some degree the flexing angle of the backrest's upper part. The spring means serve positively to join the upper and lower backrest portions to prevent translational movement therebetween. As the spring means are flexed, the wire cable secured in the passageway of the plastic support strut limits the elongation and ultimate yield or breaking point of the strut. The cable controls elongation of the strut to permit flexing and yet prevents tensile failure by insuring that the plastic support strut is not flexed beyond the tensile limit of the material from which it is constructed. A problem encountered with this structure derived from change in characteristics of the wire cable and spring strut after extended periods of time or unusual use or abuse.

The herein invention focuses on avoiding such problems by providing a flexible spring assembly which includes specially constructed holder means for the spring having restrictive engagement means which will not change in function characteristics and yet prevent flexing of the spring beyond the tensile limit of the material from which it is constructed.

SUMMARY OF THE INVENTION

A chair having a seating frame which includes a lower backrest frame portion upstanding thereon and an upper backrest frame portion, said backrest portions being interconnected by a pair of substantially identical flexible spring means secured between the lower and upper backrest frame portions. Each spring means comprises an elongated, flat or blade spring, preferably of laminated structure, having opposite ends. Each end of the spring is secured within a holder or channel member which is closed at one end and open at its opposite end for inserting the spring into the holder. The spring is secured within a holder or channel member adjacent the closed end thereof and offset laterally from the longitudinal axis of the holder or channel. The open ends of each holder have stop flange outwardly thereof.

When the spring is secured in a pair of holders, the holders are spaced apart at their open ends a predetermined distance or gap to effect limitation of the angle of flexure of the spring because of restrictive engagement of the flanges one with the other when the spring means are installed between the upper and lower backrest frame portions.

The upper backrest frame portion include two lateral, hollow, peripheral depending frame ends, and the lower backrest frame portion has two lateral, hollow, peripheral upstanding frame ends. The depending frame ends are arranged to be aligned, respectively, with the upstanding frame ends. The flexible spring means preferably are installed partially within the interior of the hollow, aligned peripheral frame ends of the backrest portions to extend outwardly from open extremities of said frame ends. The flanges of the holders are exposed exterior of the backrest frame portions for effecting the restrictive movement engagement thereof so as to prevent the blade spring from flexing beyond the tensile limit of the material from which it is constructed.

BRIEF DESCRIPTION OF THE DRAWINGS

FIG. 1 is a perspective view of a chair having the flexible spring assembly embodying the invention installed between the backrest frame portions thereof;

FIG. 2 is a fragmentary longitudinal sectional view of a portion of the backrest frame portions of said chair having said flexible spring assembly installed, the backrest frame portions being in a non-flexed or at rest position;

FIG. 3 is a fragmentary view similar to that of FIG. 2 illustrating the backrest frame portions in flexed displacement; and FIG. 4 is a sectional view taken along line 4—4 of FIG. 2 and in the direction indicated generally.

DESCRIPTION OF THE PREFERRED EMBODIMENT

Referring to FIG. 1, the chair embodying the invention is designated generally by the reference numeral 10. Chair 10 includes a frame 11 having an upper backrest portion designated generally 12 and a unitary seat and lower backrest portion designated 14.

The upper backrest portion 12 includes a peripheral, inverted U-shaped frame member 16 providing a pair of spaced apart, depending frame member ends 18 connected across the upper ends thereof by a curved bridging segment 20. A backrest pad or cushion 22 is secured between the frame member ends 18. Each frame member end 18 has lower extremities 24 that are open or hollow. The frame member 16 is formed of metal stock or tubing and has a cross-sectional configuration which can be rectangular, circular, or any other suitable configuration. The frame member 16 also can be formed from a suitable strong, molded synthetic plastic or composition material so long as it is rigid and hollow. Additionally, the frame member 16 can be of any suitable configuration other than the U-shape that is illustrated.

The unitary seat and lower backrest portion 14 includes a unitary frame assembly formed of hollow tubular stock similar to that of the frame member 16. The assembly includes a pair of like inverted U-shaped members, each providing a pair of depending legs 26 braced by a crossmember 28. Each pair of legs 26 is connected by an upper saddle or bridge segment SO. The bridging segments 30 are spaced apart the distance between the conjoined leg pairs 26.

A combination seat and lower backrest frame 32 is secured between the bridging or saddle segments 30. The combination frame 32 likewise is formed of tubular stock and includes a horizontally oriented seat-retaining portion 34 of generally U-shaped configuration and an upstanding backrest portion formed as an extension of the seat portion 34. The seat portion 34 includes a pair of side segments 36 connected at the front end of the chair by a front segment 38. Extending upwardly from each side segment 36 at the rear end of the chair 10 are straight segments 40 which are hollow and open at their respective upper extremities 42. The segments 40 are arranged in parallel relationship and are spaced apart laterally the same distance as the depending frame member ends 18. The upstanding segments 40 thereby cooperate to provide the lower backrest frame portion of the chair 10. As FIG. 1 illustrates, the members 18 and 40 are interconnected. i.e., each member 18 is aligned and is in registry with a respective member 40. The joint or juncture between each of the interconnected members 18 and 40 is concealed by a bellows-like appearing flexible sleeve 44 so that the backrest 12 of the chair 10 appears to be unitary. A seat pad or cushion 46 is installed on the seat frame members 36 and 38. The backrest pad 22 can include an optional lower backrest pad portion 48 positioned between the lower backrest segments 40. The chair construction is such that the lower backrest portion 48 can be omitted, if desired, without sacrificing the utility of the chair, or a separate pad, not shown, can be installed.

FIGS. 2–4 illustrate flexible spring means embodying the invention for conjoining or connecting the upper and lower backrest frame portions 12 and 14. A pair of identical spring means is installed on a chair so that only one need be described in detail. Each of said spring means 50 includes an upper holder member 52, a lower holder member 54, and a substantially non-extensible flexible insert comprising a flat or blade spring 56 secured at opposite ends 57 thereof within the two holders 52 and 54.

The holders 52 and 54 are substantially identical in construction and configuration. Each is a channel formation or generally U-shaped having opposing leg members 58 and 60 joined by a connecting member 62 at end thereof. The upper and lower holder or channel members 52 and 54 are positioned within the open frame ends 18 and 40 respectively and are secured therein by fasteners 64 that extend through the frame ends 18 and 40. Preferably, the channel members 52 and 54 are rigid and are made of aluminum, but can be made of any desired material so long as they restrict movement and function as described. The end 65 of a holder opposite its closed end formed by connecting member 62 is open for receiving the blade spring 56.

The flat or blade spring 56 is elongated and is secured at its respective ends 57 within the channel members 52 and 54 by fasteners 66. As best seen in FIG. 4, each end 57 of the blade spring 56 is secured within a channel member 52 offset from the longitudinal center line or axis of the channel member. The spring 56 is positioned in closer proximity to the front facing leg 58 of the holder because of the desired greater flex or travel of the spring in one direction away from the front end of the chair 10. As seen in FIGS. 2 and 3, spring 56 can enable the desired flexing of the upper backrest portion 12 relative to the lower backrest portion 14 in the direction of arrow A. Spring 56 preferably is a laminated blade or flat spring, but other spring materials may be feasible so long as the desired flexing and strength is provided.

To limit the bending of the upper backrest portion 12 relative to the lower backrest portion 14, the distal ends of each leg member 58 and 60 are formed with outwardly extending flanges 68 and 70. Preferably, the leg members 58 are positioned facing toward the front of the chair 10 and are slightly longer than the leg members 60 which are positioned facing toward the rear of the chair 10. Additionally, the flanges 70 can extend outwardly a greater distance than the flanges 68 so as to provide a more effective limitation to the backward motion of the upper backrest portion 12 typically encountered during use. As illustrated, the flanges 68 and 70 not only limit the desired bending of the backrest frame portions one relative to the other, but they also serve stop formations against which the open ends of the frame members 18 and 40 engage or abut when the channel members 52 and 54 are inserted therein.

To assemble the spring means 50, the flat spring 56 is inserted within the channel members 52 and 54 and is secured therein by the fasteners 66 to form a single unit. Thereafter, the upper channel member 52 is inserted within the open end of the frame member 18 and the lower channel member 54 is inserted within the open end of the frame member 40. The fasteners 64 are then inserted within corresponding apertures in the frame members 18 and 40 and the channel members 52 and 54 to secure the channel members 52 and 54 within the frame members 18 and 40. In installing the spring means 50, due consideration to proper placement of bellows sleeve 44 will be given before the spring means 50 installation is completed.

In operation, when the upper backrest portion 12 is at rest position as illustrated in FIG. 2, the upper backrest portion 12 is maintained in vertical alignment with the lower backrest portion 14 by the spring means 50. Additionally, due to the length of the flat spring 56 and the positioning of the apertures for the fasteners 66, a slight gap 71 is provided between the two flanges 68 as well as a slight gap 72 between the two flanges 70 so as to permit flexing of the upper backrest portion 12 relative to backrest portion 14. Since the front leg 58 is slightly longer than the rear leg 60, the gap 72 between the flanges 70 is slightly larger than the gap 71 between the flanges 68. Accordingly, as FIG. 3 illustrates, upon rearward flexing of the upper backrest portion 12 along the line "A", the flange 70 of the upper backrest portion 12 rotates through the larger gap 72 until it engages against the flange 70 of the lower backrest portion 14 and restricts further rearward movement of the upper backrest portion 12. This larger angular displacement of the backrest portion 12 along the line "A" is achieved by reason of the spring 56 being secured in the holders 52 offset from the center line or axis of the aligned holders in a direction away from the flanges 70 and the larger gap 72 therebetween. This enables the spring 56 to be flexed a greater angular distance consistent with the larger gap 72 for movement of the backrest portion 12. Also to be noted is that the leg 60 of the holder is thicker than the opposing leg 58 for contributing to additional strength at the point of contact where angular movement of the portion 12 is stopped. By so securing the spring 56 offset in the holders 52, maximum strength and extent of angular travel of the spring is realized. Further maximum use of limited space available for the flexing or angular movement of the spring is permitted.

During the rearward flexing of the portion 12, the flat spring 56 is displaced or flexed. When the user leans forward spring 56 causes automatic return of upper backrest portion 12 along the line "A" to its original at rest position. As upper backrest portion 12 returns to the rest position, flanges 68 restrict forward movement of the upper backrest portion 12 in a manner similar to that of the flanges 70. Since a large forward displacement of the upper backrest portion 12 is typically not desirable in normal use of the chair 10, the gap 71 between the flanges 68 can be smaller. It is to be noted, however, that the size of the flanges 68 and 70 as well as the gaps 71 and 72 between them and the length of the leg members 58 and 60 can vary so long as the spring means 50 functions as described.

In every position of the upper backrest portion 12, the sleeve or bellows 44 covers the gaps 71 and 72 between the flanges 68 and 70 and conceals the operative spring means 50.

The flexing or deflection of the spring means 50 enables the upper backrest frame part to be displaced from the normal plane of the backrest assembly or relative to the lower backrest frame part as illustrated by FIG. 3. This flexing or displacement of the upper backrest frame part relative to the lower frame part contributes to the desired feature for seating comfort. The chair back flexing features along with optimum user comfort as described in U.S. Pat. No. 4,603,904 commonly owned herewith likewise are realized by the herein spring means or assembly 50. The channel or holder members will retain their structural specifications over long periods of chair use while preventing undue flexing of the spring 56.

The simplicity and economy of the spring means 50 and its installation between the upper and lower backrest frame parts can be readily appreciated. Simple tooling and parts are involved. Minor variations in dimensions and configuration of component parts of the invention may occur to the skilled artisan without departing from the scope of the invention as set forth in the appended claims.

We claim:

1. A chair comprising, a seat assembly which includes a support frame and depending leg members, a lower backrest frame part having a pair of spaced apart frame members upstanding relative to the seat support frame, an upper backrest frame part having a pair of spaced apart depending frame members arranged in registry with the upstanding frame members, said frame members being hollow with open extremities, and spring means secured between each registered pair of frame members to provide an articulated, flexible spring backrest for the chair, each spring means including a pair of elongate holder members of like substantially U-shaped configuration closed at one end thereof and open at the opposite end thereof, a substantially nonextensible flexible insert secured in said holder members adjacent said closed ends thereof and extending through said open ends thereof between the holder members, said open ends facing toward and spaced one from the other to form a gap therebetween, said hollow members being installed relative to said registered pair of frame members so as to maintain the flexible insert extending therebetween, said opposite ends of the holder members each having cooperating restrictive flange engagement means integral therewith and extending outwardly of said open extremities for limiting flexing of the insert beyond the tensile limit thereof in diametrically opposite directions of movement of the upper backrest frame part relative to the front facing end of the chair.

2. The chair as defined in claim 1 wherein said holder members are secured within the interiors of said frame members and said flexible insert is a flat spring secured at its opposite ends in said holder members offset from the longitudinal center line or axis of the holder members.

3. The chair member as defined in claim 2 wherein said flat spring is a laminated member.

4. The chair as defined in claim 1 wherein said engagement means comprises a pair of flanges on said opposite ends of each of said holder members, each flange of the pair extending in a direction outwardly of said holder member and in opposite directions one relative to the other with the opposing flanges of opposite holder members being spaced one from the other to provide gaps therebetween.

5. The chair as defined in claim 4 wherein said holder members ar constructed of a substantially rigid material so that upon flexing of said insert said flanges engage one another to limit the flexing of said insert.

6. The chair as defined in claim 5 wherein one flange of a pair of flanges is larger than the second flange of the pair, and the larger flange faces toward the rear end of the chair, the gap between said larger flanges being greater in width than that of the gap between the smaller flanges.

7. A flexible spring assembly for use in a flexible backrest assembly for a chair, the backrest assembly including a lower backrest frame part and an upper backrest frame part, said backrest frame parts being hollow and having open extremities facing toward one another and spaced apart, said spring assembly comprising spring means adapted to be secured in the interior of said frame parts, said spring means including at least one pair of elongate holder members of like, substantially U-shaped configuration closed at one end thereof and open at the opposite end thereof, a substantially nonextensible flexible spring insert secured in said holder members adjacent said closed ends thereof and extending through said open ends thereof between the holder members, said open ends facing toward and spaced one from the other to form a gap therebetween, said holder members being installed relative to said frame parts so as to maintain the flexible spring insert extending therebetween, said holder members each having portions protruding outwardly of said open extremities forming cooperating flange engagement means integral with said holder members adjacent said open ends thereof for limiting flexing of the insert beyond the tensile limit thereof upon movement of the upper backrest frame part in diametrically opposite directions relative to the front facing end of the chair.

8. The spring assembly as defined in claim 7 wherein said flexible insert is a flat spring.

9. The spring assembly as defined in claim 8 wherein said flat spring is a laminated member.

10. The spring assembly as defined in claim 7 wherein said engagement means include a pair of flanges on said open ends of said holder members, each flange of the pair extending in a direction outwardly of said holder members and in opposite directions one relative to the other with the opposing flanges of opposite holder members being spaced one from the other in different amounts.

11. The spring assembly as defined in claim 10 wherein said holder members are constructed of a substantially rigid material so that upon flexing of said insert said flanges engage one another to limit the flexing of said insert.

12. The spring assembly as defined in claim 10 wherein one flange of a pair flanges is larger than the second flange of the pair, and the larger flange faces toward the rear end of the chair, the space between said larger flanges being greater in width than that of the space between the smaller flanges.

13. The spring assembly as defined in claim 12 wherein said chair includes a seat assembly having a support frame and depending leg members, said lower backrest frame part includes a pair of spaced apart frame members upstanding relative to said seat support frame, said upper backrest frame part includes a pair of spaced apart depending frame members arranged in registry with said upstanding frame members and wherein one spring means is secured between each registered pair of frame members.

14. A chair comprising, a seat assembly which includes a support frame and depending leg members, a lower backrest frame part having a pair of spaced apart frame members upstanding relative to the seat support frame, an upper backrest frame part having a pair of spaced apart depending frame members arranged in registry with the upstanding frame members, said missed line spring means secured between each registered pair of frame members to provide an articulated, flexible spring backrest for the chair, each spring means including a pair of elongate holder members of like, substantially U-shaped configuration closed at one end thereof and open at the opposite end thereof, one leg of each holder member being thicker and shorter than the opposing leg thereof and facing towards the rear of the chair, a substantially non-extensible flexible spring secured off-center in said holder members relative to the longitudinal center line of said holder members and adjacent said closed ends thereof an extending through said open ends thereof between the holder members, said open ends facing toward and spaced one from the other to form a gap therebetween, said holder members being installed inside said registered pair of frame members with the flexible spring extending therebetween, said holder member each having flange means integrally formed on said legs adjacent said open ends of the holders and protruding outwardly of the open extremities and into the spacing between the backrest frame parts, said flange means constructed and arranged to limit angular movement of the upper backrest part in diametrically opposite directions by interengagement between protruding opposing flange means whereby to limit flexing of the spring beyond the tensile limit thereof.

15. The chair as described in claim 14 wherein said spring is a flat spring secured at its opposite ends adjacent the closed ends of the holder members.

16. The chair as described in claim 15 wherein the legs of each of the holder members have integral flanges extending in a direction outwardly of the holder members and in opposite directions one relative to the other, said flanges on the thicker legs of the holder members being spaced apart a distance greater than the spacing between flanges on the inner legs of the holder members and related to the offset securement of the spring in the holder members to enable a greater angular movement of said upper backrest part in the direction toward the rear end of the chair.

* * * * *

UNITED STATES PATENT AND TRADEMARK OFFICE

CERTIFICATE OF CORRECTION

PATENT NO. : 4,869,552

DATED : September 26, 1989

INVENTOR(S) : Thomas H. Tolleson, Gregory M. Saul and R. Duane Ware

It is certified that error appears in the above-identified patent and that said Letters Patent is hereby corrected as shown below:

Column 2, line 68, delete "SO" and insert --30--;

Column 5, line 63, delete "hollow" and insert --holder--;

Column 7, line 29, delete "missed line" and insert --frame members being hollow with open extremities, and--;

Column 8, line 5, delete "an" and insert --and--; and

Column 8, line 30, delete "inner" and insert --thinner--.

Signed and Sealed this

Fourth Day of September, 1990

*Attest:*

HARRY F. MANBECK, JR.

*Attesting Officer*

*Commissioner of Patents and Trademarks*